US007318384B2

(12) United States Patent
Gray

(10) Patent No.: US 7,318,384 B2
(45) Date of Patent: Jan. 15, 2008

(54) DIAGONAL SEWING GUIDE—SEW EASY GUIDE

(76) Inventor: Sara Gray, 6770 N. 600 West, Middletown, IN (US) 47356

( * ) Notice: Subject to any disclaimer, the term of this patent is extended or adjusted under 35 U.S.C. 154(b) by 0 days.

(21) Appl. No.: 11/271,620

(22) Filed: Nov. 10, 2005

(65) Prior Publication Data

US 2006/0107882 A1 May 25, 2006

Related U.S. Application Data

(60) Provisional application No. 60/627,655, filed on Nov. 13, 2004.

(51) Int. Cl.
*D05B 11/00* (2006.01)
*D05B 35/10* (2006.01)
*D05B 29/00* (2006.01)

(52) U.S. Cl. ..... 112/117; 112/136

(58) Field of Classification Search ..... 112/117, 112/136, 260, 235, 236, 237, 240; 33/1 G, 33/1 B, 4, 5, 3 A
See application file for complete search history.

(56) References Cited

U.S. PATENT DOCUMENTS 312,196 A * 2/1885 Freeman ..... 112/136
647,339 A 7/1900 Thompson
846,006 A 12/1907 Bryson
907,485 A * 12/1908 Fellows ..... 112/136
2,657,654 A * 11/1953 Overman et al. ..... 112/136
2,751,869 A * 6/1956 Walcoff ..... 112/260
3,835,798 A * 9/1974 Fresard ..... 112/150
4,069,779 A * 1/1978 Klein ..... 112/136
4,779,346 A 10/1988 Schafer
5,819,422 A * 10/1998 Schafer ..... 33/1 B
6,854,189 B2 * 2/2005 Schafer ..... 33/1 B

OTHER PUBLICATIONS

Pam Bono Designs—The Angler and Angler II.
Great American Quilt Factory's Possibilities series of tools and devices.
Checker Distributors Shape Cut device.
Omnigrip rulers available through many dealers and distributors.
Quilt Bus rulers.
Various Martingale rule and template devices.

* cited by examiner

*Primary Examiner*—Ismael Izaguirre
(74) *Attorney, Agent, or Firm*—John D. Ritchison

(57) ABSTRACT

A sewing and quilting device called a SEW EASY GUIDE. This device features an essentially rectangular strip of thin, clear, and flexible plastic material with markings, the strip having a top surface, a length, and a width, and the device having a needle aperture and a means to attach the device directly to a sewing machine, such as an adhesive surface on the device. This guide device enables the user to operate a sewing machine with the guide on the topside of the fabric and to see visibly the guide markings while traversing across the fabric with the sewing machine.

16 Claims, 7 Drawing Sheets

Figures 1, 1A, 1B:
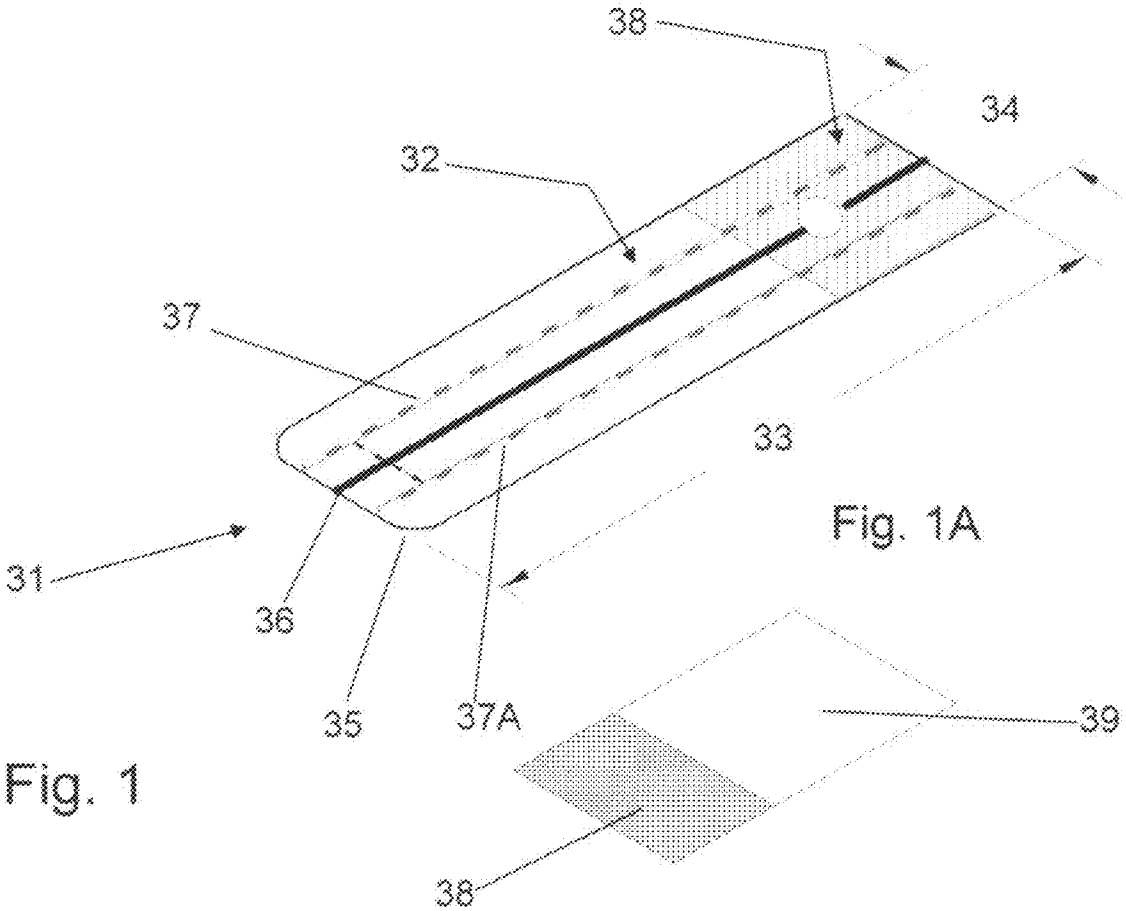

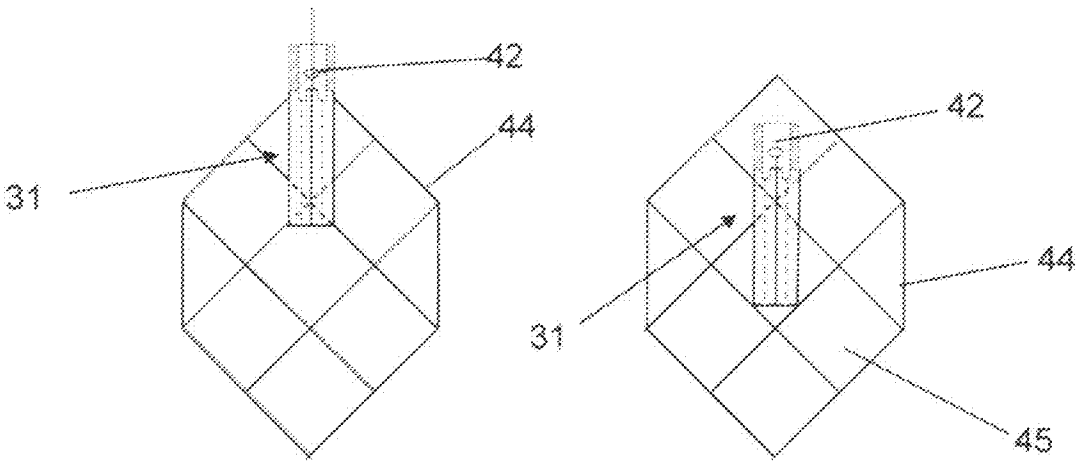
Fig. 4A
Fig. 4B
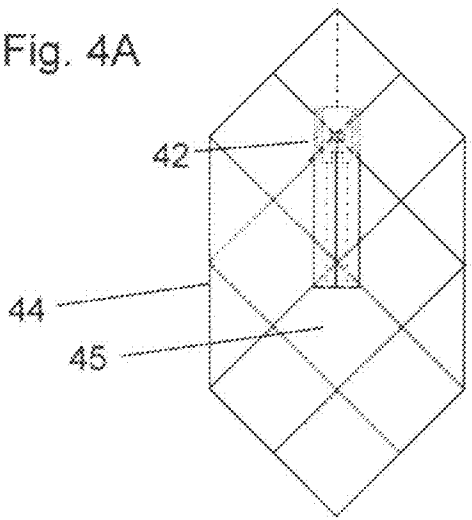
Fig. 4C
Fig. 4

49
49B
31
42

31
49B
49
see Fig. 6A 31
49B
49

52
49B
49

DIAGONAL SEWING GUIDE—SEW EASY GUIDE

CROSS-REFERENCE TO RELATED APPLICATIONS

This application claims the benefit of Provisional Patent Application Ser. No. 60/627,655 filed Nov. 13, 2004 by the present inventor and titled "Diagonal Sewing Guide". This device is now identified as "Sew Easy Guide".

FIELD OF INVENTION

This invention relates to a diagonal sewing guide that aids the sewing process, especially but not limited to quilting and specialty sewing. The new device is a Diagonal Sewing Guide identified as the SEW EASY GUIDE.

FEDERALLY SPONSORED RESEARCH

Not Applicable.

SEQUENCE LISTING OR PROGRAM

Not Applicable.

BACKGROUND—FIELD OF INVENTION

Sewing diagonally across a square of material is used frequently in making quilts and other sewing projects. It is used to make half-square triangles, to join binding strips, to make "connecting corners", and other connections of the fabric. It is commonly used to sew quilts made of squares. In the past, to accurately sew diagonally across a square required marking or creasing the square was needed. This method involves a significant amount of time for one that has many squares to mark and this method can leave residue from the physical marks.

A. Introduction of the Problems Addressed

When marking the diagonal, a sewer or quilter has to be careful that the mark will not permanently discolor the fabric or leave a residue on the fabric. Marks made with chalk, pencils, or wheels are purposefully easy to remove. In fact, sometimes they disappear before the quilter wants them to leaving the quilter having to re-mark the fabric or (worse) estimate where the stitch should be placed. Creasing (pressing) the diagonal eliminates the concern and worry of marks, but the crease is often "difficult to see" and even more "difficult to follow" when actually sewing. Having a crease also means that the fabric is not perfectly flat when being sewn. This may create a greater chance of inaccuracy. In addition, creasing is of "limited use" when making half-square triangles and is of essentially "no use" when quilting.

B. Prior Art

Historically, sewing and quilting aids or guides have been too large. In addition, they were at best marked and delineated with complex lines and indicators for use by the seamstress. Several devices have attempted to improve upon the needs for easy marking or indicating where the seams need to be placed on the quilting fabrics. In use, the prior art devices—complex in nature—were difficult to use and install with a sewing machine and therefore limited in use. The new SEW EASY GUIDE addresses these limitations and provides a solution to the stated problems.

Many sewing machines have a "quilting guide" accessory that can be used to sew parallel lines after marking only the first line. This is well-suited to sewing on a plain (non-pieced) fabric, but the typical "quilting guide" does not work well on a fabric made with quilt squares unless the squares are "exactly and precisely" square. Further, the quilting guide accessory is totally unsuitable for half-square triangles, joining binding strips, and making connecting corners.

Other sewing guides on the market, for example ones that attach to the sewing machine bed, can be helpful in sewing half-square triangles, joining binding strips, and making connecting corners, but only if a quilter is comfortable with guiding the fabric on top of the guidelines. However, these guides are not suitable for quilting because they attach to the sewing machine bed where the guidelines are covered by a quilt or sewing project.

For the many avenues and attempts to solve the needs to accurately and easily mark the quilts or facilitate the sewing, all the known prior art has fallen short of solving the problems.

There are but a few patents for sewing and drawing guides such as taught by the SEW EASY GUIDE. Examples of prior sewing guides or marking indicators begin with U.S. Pat. No. 647,339 issued to Thompson (1900). This teaches an apparatus for mechanical drawings. While possibly helpful to layout design shapes and patterns, the invention does not teach any use directly with a sewing machine or quilting apparatus.

A U.S. Pat. No. 846,006 issued to Bryson (1907) teaches the well-known combination protractor and ruler device. Here, a helpful layout device is taught but no mention of the embodiment or use as described for the SEW EASY GUIDE.

Another example include a U.S. Pat. No. 4,779,346 issued to Schafer (1988) which teaches a transparent, measuring device with markings on its surface. It is a much thicker device ad teaches no use with sewing or quilting machines.

Several devices have been commercialized that involve marking fabric for quilting and sewing. None teach a use with a machine where the guide is visible and on top of the fabric. The other devices known lie under the fabric and contiguous to the machine bed or are simply design layout devices. Examples include transparent rulers and guides from Pam Bono Designs—The Angler and Angler II; Great American Quilt Factory's Possibilities series of tools and devices; Checker Distributors Shape Cut device; Omnigrip rulers available through many dealers and distributors; Quilt Bus rulers; and finally, various Martingale rule and template devices.

None of the prior art teaches all the features and capabilities of the SEW EASY GUIDE device. As far as known, there are no devices at the present time which fully meet this need with as simple and few of components and superior operation as the present SEW EASY GUIDE device. It is believed that this device is made with fewer and less complex parts, of a more simple and durable design, and with much with much easier and improved method of use than any previous sewing guide devices. As far as known, there are no devices at the present time which fully meet the need for a quilting or sewing guide device as well as the SEW EASY GUIDE Device.

SUMMARY OF THE INVENTION

The Diagonal Sewing Guide known as the SEW EASY GUIDE enables one to easily and accurately sew or quilt diagonally across squares without the time-consuming task of marking or creasing the squares. It is comprised of parts including, but not limited to, an essentially rectangular strip of thin, clear and flexible plastic with guide markings, the strip having a top surface, having a needle aperture and a means to attach the guide device to a sewing machine. Since there is no marking involved, there are no worries about marks coming off too soon or staying on where they are not wanted. Since a crease is not necessary for a guideline, the fabric remains flat during sewing, which increases the accuracy of the sewn line.

The Diagonal Sewing Guide, known as the SEW EASY GUIDE, is very easy to use. The device simply attaches to the bottom of the presser foot, without harming the presser foot, and "rides" on top of the fabric. This makes it easier to see where one is sewing. The guide works, when quilting or topstitching, even if the quilter's squares are not perfectly square.

OBJECTS AND ADVANTAGES

There are several objects and advantages of the SEW EASY GUIDE. There currently exist few mechanisms for aiding a seamstress or quilter in the fashion afforded by this invention. Having a simple seam guide that is attached to the sewing machine and that "rides" above the fabric to be sewn is an advancement long-sought after in the sewing and quilting communities. In this regard, it would be advantageous to have an improved guide device that solved these problems. This improvement would increase the ability of a seamstress to use quickly and efficiently sew common shapes in a very repeatable manner. Thus, improving the quality and effectiveness of the user.

Advantages and objects of the present invention is that it is removable, re-usable, flexible, durable, and inexpensive. Further, it is versatile in that it can be used not only as described below, but in a variety of other situations as may occur to the sewing enthusiast.

Other advantages and additional features of the present SEW EASY GUIDE will be more apparent from the accompanying drawings and from the full description of the device. For one skilled in the art of sewing devices and improvements for sewing templates and guides, it is readily understood that the features shown in the examples with this mechanism are readily adapted to other types of sewing guide improvements.

DESCRIPTION OF THE DRAWINGS—FIGURES

The accompanying drawings, which are incorporated in and constitute a part of this specification, illustrate an embodiment of the SEW EASY GUIDE Device that is preferred. The drawings together with the summary description given above and a detailed description given below serve to explain the principles of the SEW EASY GUIDE Device. It is understood, however, that the SEW EASY GUIDE Device is not limited to only the precise arrangements and instrumentalities shown.

FIG. 1—The general configuration of the SEW EASY GUIDE Device.

Figures 2, 2A, 2B:
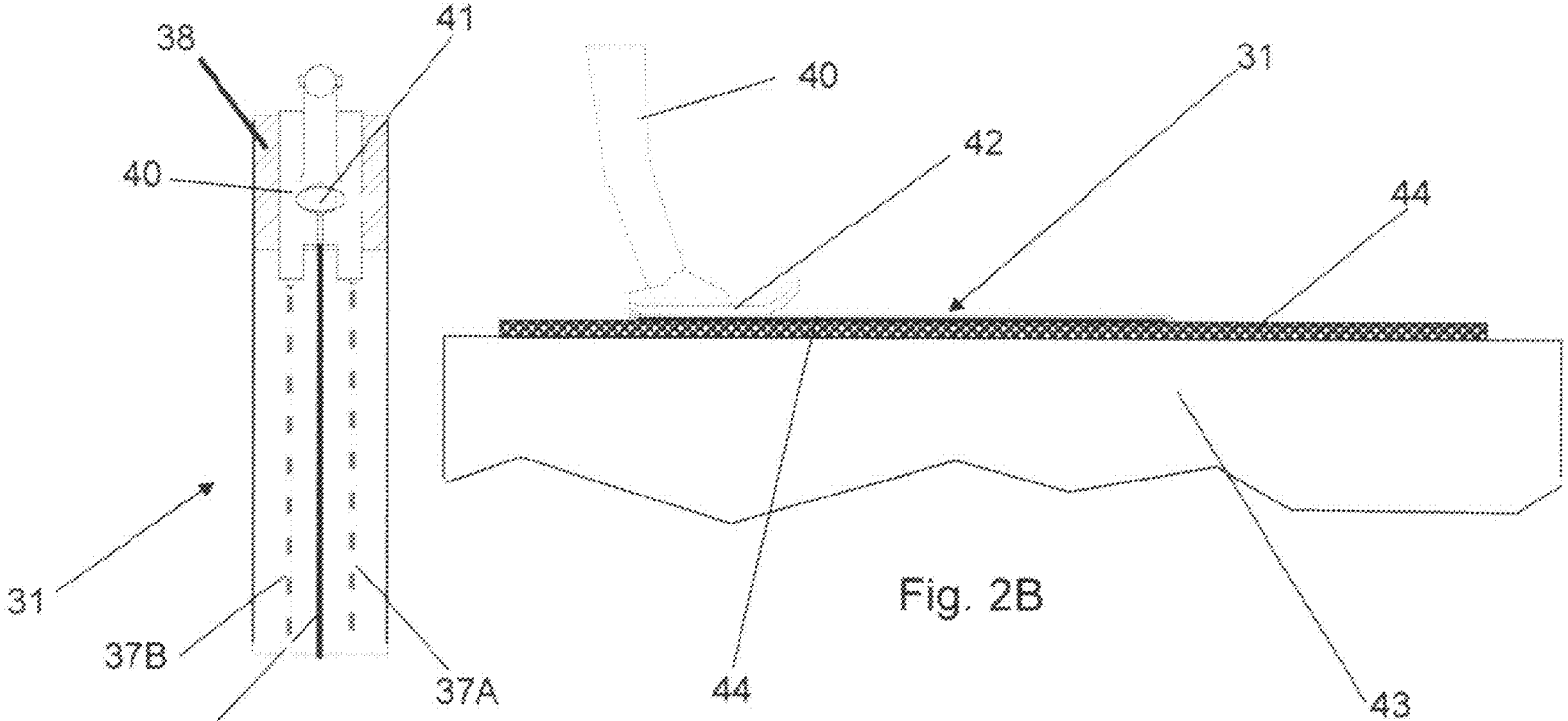

FIG. 2—SEW EASY GUIDE Device attached to presser foot-top view and side view.

Figure 3:
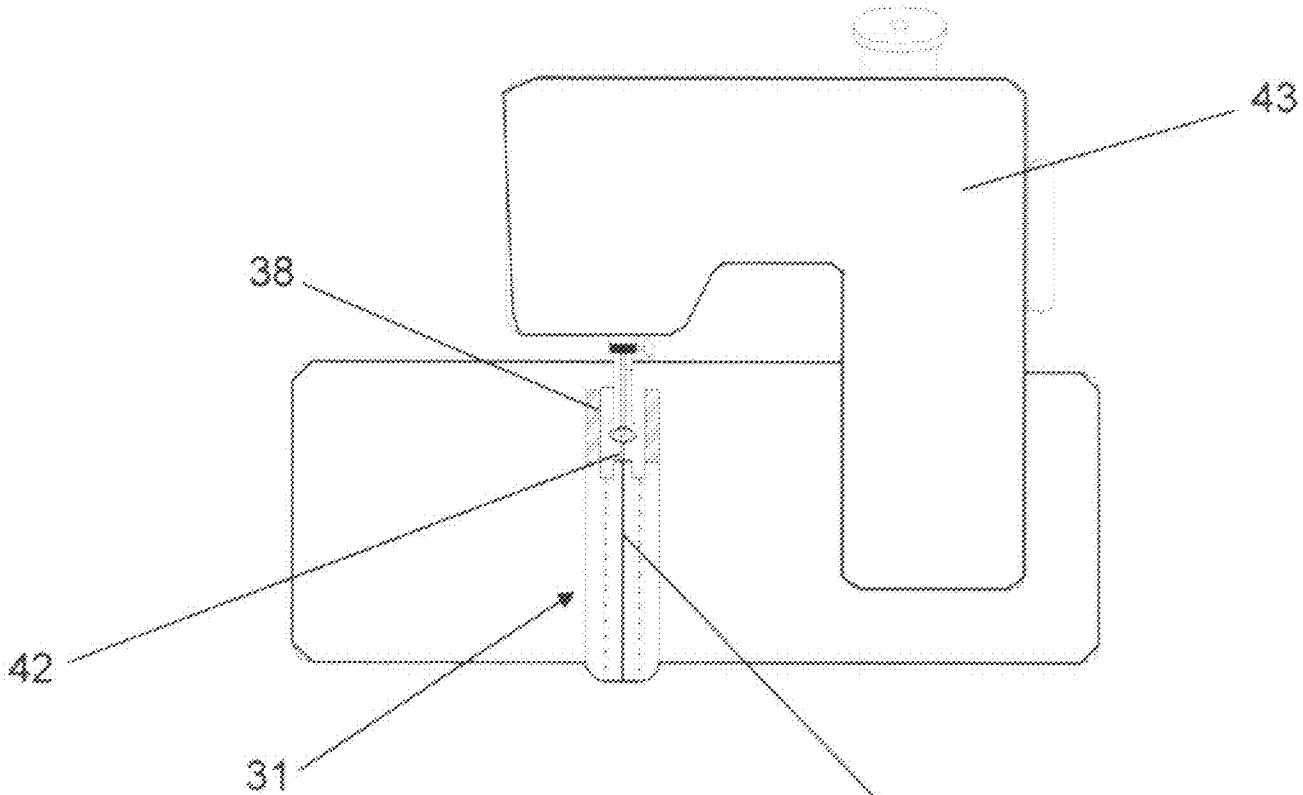

FIG. 3—SEW EASY GUIDE Device attached to presser foot and foot attached to sewing machine.

FIG. 4—Top view of a SEW EASY GUIDE Device guide showing how to quilt diagonally across squares.

Figure 5:
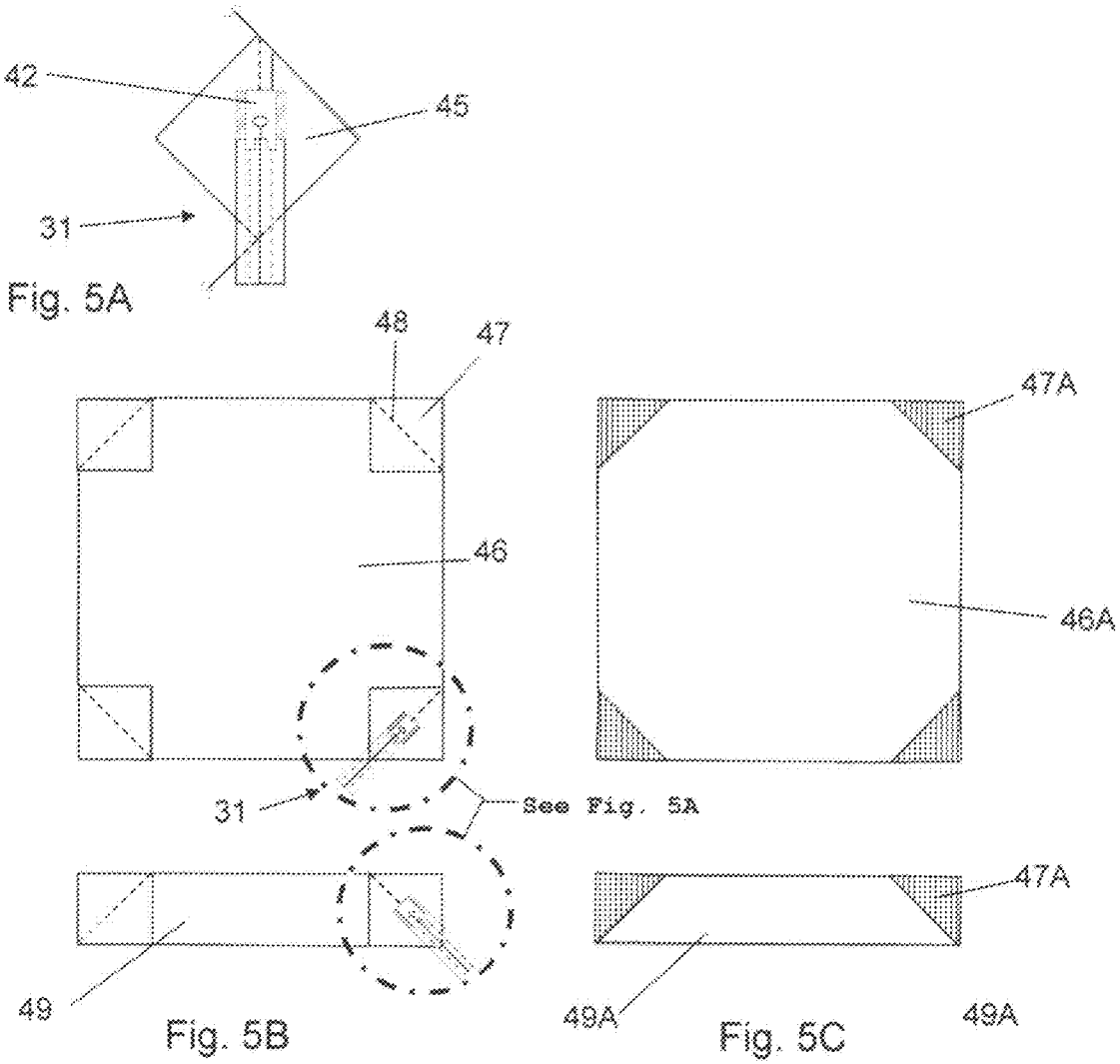

FIG. 5—Top view of a SEW EASY GUIDE Device guide showing how to sew diagonally across squares to make triangles at corners of squares (connecting corners) or triangles at corners of rectangles (flying geese units and many other similar units too numerous to mention).

Figures 6, 6A, 6B, 6C, 6D:
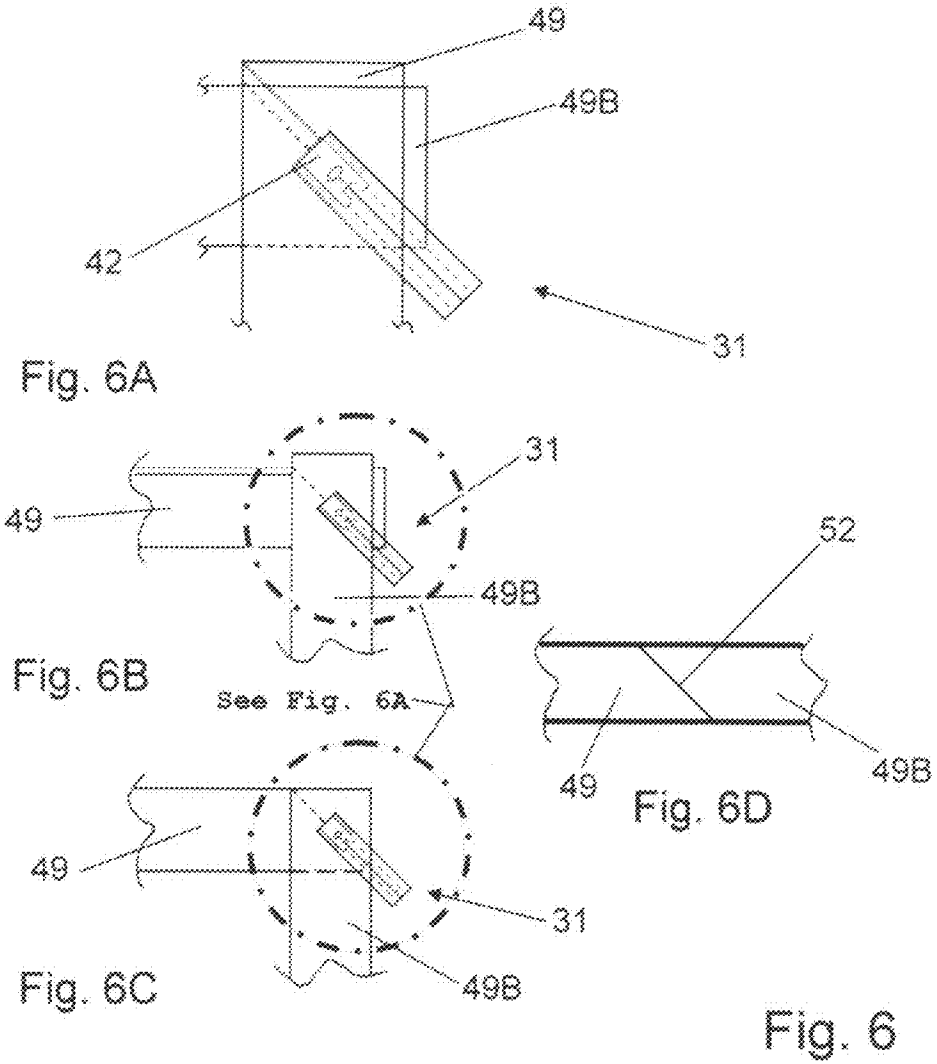

FIG. 6—Top view of a SEW EASY GUIDE Device guide showing how to sew a diagonal seam to join fabric strips, for binding or borders or any other situation where a diagonal seam is desired when joining two fabric strips.

Figure 7:
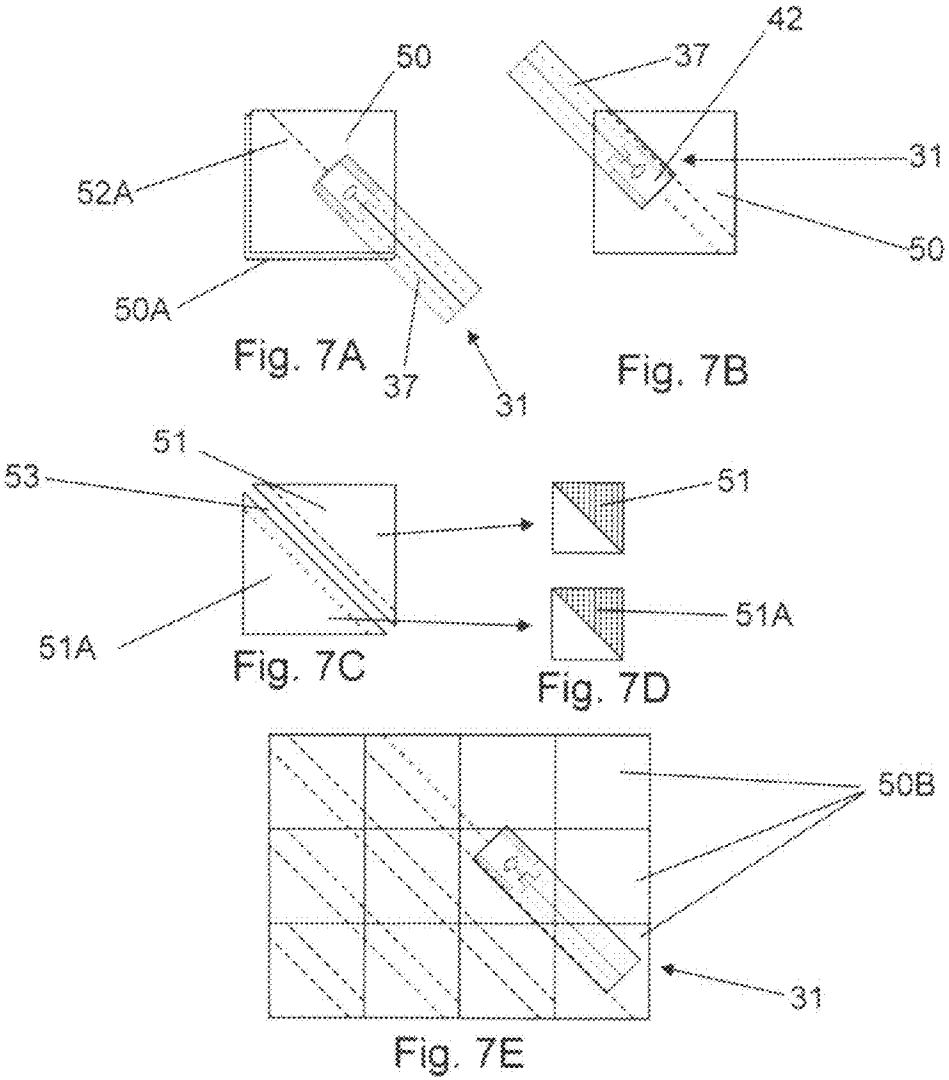

FIG. 7—Top view of a SEW EASY GUIDE Device guide showing how to use the guide to make half-square triangles from pairs of squares or from a drawn grid of squares.

DESCRIPTION OF THE DRAWINGS—REFERENCE NUMERALS

The following list refers to the drawings:

| | |
|---|---|
| 31 | general assembly of the SEW EASY GUIDE Device |
| 32 | top surface of the SEW EASY GUIDE Device |
| 33 | length of the SEW EASY GUIDE Device |
| 34 | width of the SEW EASY GUIDE Device |
| 35 | corner of the SEW EASY GUIDE Device |
| 36 | Centerline guide mark of the SEW EASY GUIDE Device |
| 37 | offset line approximately a scant ¼ inch from the centerline in one direction on the SEW EASY GUIDE Device |
| 37A | offset line approximately a scant ¼ inch from the centerline in the opposite direction on the SEW EASY GUIDE Device |
| 38 | means to connect/adhesive on the surface of the SEW EASY GUIDE Device |
| 39 | cover means over the adhesive (38) |
| 40 | Presser foot on the sewing machine |
| 41 | needle aperture |
| 42 | presser foot flat plane area |
| 43 | sewing machine |
| 44 | general fabric being sewn or quilted |
| 45 | small geometrical shape being sewn |
| 46 | large fabric square being sewn |
| 46A | large fabric square with triangles folded |
| 47 | triangle corner segment of fabric (to be folded) |
| 47A | triangle corner segment of fabric folded |
| 48 | folded edge of fabric |
| 49 | first plain fabric strip |
| 49A | folded fabric strip |
| 49B | second plain fabric strip |
| 50 | Fabric piece, here as a square shape |
| 50A | Second contiguous fabric piece, here as a square shape |
| 50B | A plurality of marked shapes on a Fabric piece |
| 51 | Cut or separated fabric triangles of the half square |
| 51A | Cut or separated fabric triangles of the half square |
| 52 | sewn seam |
| 52A | line of seam to be sewn |
| 53 | cut apart area |

DETAILED DESCRIPTION OF PREFERRED EMBODIMENT

The present device is a mechanism for a sewing guide called a SEW EASY GUIDE 31.

This mechanism is comprised of an essentially rectangular strip of thin, clear and flexible plastic with markings, the strip having a top surface 32, a length 33 and a width 34, having a needle aperture 41 for a needle to reciprocate therein, and having a means 38 to attach the device 31 to a sewing machine 43.

The improvement over the existing art is providing a device that is removable, re-usable, flexible, durable, inexpensive, and versatile.

There is shown in FIGS. 1–7 a complete operative embodiment of the SEW EASY GUIDE Device 31. In the drawings and illustrations, one notes well that the FIGS. 1–7 demonstrate the general configuration of this invention. The preferred embodiment of the device is comprised of only a few parts as shown in FIG. 1–7 of the drawings.

These parts include, but are not limited to, an essentially rectangular strip of thin, clear and flexible plastic with markings, the strip having a top surface 32, a length 33 and a width 34, having a needle aperture 41 and having a means 38 to attach the device 31 to a sewing machine 43.

Various important features of these components are delineated in FIGS. 2–7 of the drawings and are described below in appropriate detail for one skilled in the art to appreciate their importance and functionality to the SEW EASY GUIDE Device 31.

The accompanying drawings, which are incorporated in and constitute a part of this specification, illustrate an embodiment of the SEW EASY GUIDE Device 31 that is preferred. The drawings together with the summary description given above and a detailed description given below serve to explain the principles of the SEW EASY GUIDE Device 31. It is understood, however, that the SEW EASY GUIDE Device 31 is not limited to only the precise arrangements and instrumentalities shown.

As shown in FIG. 1, the SEW EASY GUIDE Device 31 is made of transparent plastic, composite material or equal, approximately 15 mil thick. It is about 1" wide 34 by various lengths 33. A centerline 36 in color A (for example, solid black) is centered down the length of the top. A line 37 and 37A in color B (for example, dashed red) is on each side of the solid black center line, parallel to the solid black center line, approximately ¼ inch away. The corners 35 of the front end of the guide may be slightly rounded to prevent the guide 31 from catching on the quilt.

The back end of the guide has a needle aperture 41 (hole) (about ¼ inch diameter) for the sewing machine 43 needle to pass through the guide 31. The guide 31 also has a means 38 such as an adhesive to hold the guide 31 to the bottom of the presser foot 40 flat plane area 42. There is also a removable, re-usable protective cover means 39 such as a tab that protects the means 38 when the guide 31 is not on the presser foot 40.

To use the guide 31, one removes the protective tab 39 from the guide 31. One should save the protective tab 39 to use when storing the guide 31 when it is not on the presser foot 40. Choose a presser foot 40 with a wide base, and place it on the adhesive end of the guide 31 as shown in FIG. 2A, centering solid black line 36 on guide with center of presser foot's needle aperture 41. Make sure needle aperture 41 in foot is on top of hole in guide 31. It may be helpful to turn foot 40 upside down and check that the dashed lines are also centered on the bottom of the presser foot 40. Optional: If one's presser foot 44 has a slot that opens to the side of the foot, one may mark and cut a corresponding slot in the guide 31 if one wishes (remove foot 40 from guide while cutting slot to prevent damage to foot, then re-attach the guide to the foot, aligning the openings).

With guide 31 attached to foot 40, attach foot 40 to sewing machine 43 as shown in FIG. 3, one being careful not to bump guide 43 off of foot or out of alignment. Make sure needle is in center needle position 41, if the user machine has this feature incorporated 38.

With care, the guide 31 will not come off during sewing. The seamstress/quilter must just remember to use care when lifting and lowering presser foot 40 and when turning quilt, because the guide 31 is only secured by the adhesive 38 holding it to the presser foot 42. If desired, extra security can be obtained by wrapping regular invisible tape around the toes of the presser foot flat 42 and the guide 31, however one must remember not to block the needle hole 41.

Shown in FIG. 4 is how to quilt diagonally across squares: One places the quilt under the presser foot 40 and guide 31. Then one positions the needle at the corner of a square (FIG. 4A). One then stitches across the square keeping the solid black center line 36 on the guide centered over the corner of the square opposite the needle (FIG. 4B). When the needle reaches the opposite corner, one should line up the solid black line 36 of the guide 31 with the next corner and continue sewing (FIG. 4C).

FIG. 5 shows how to use "small" fabric squares 45 on top of "large" fabric pieces 46 to make triangles 47 at corners of squares (FIG. 5B) or triangles 47 at corners of rectangles (FIG. 5C). One sews the same as in FIG. 4, except guide the solid black line 36 slightly off the exact corner of the square (FIG. 5A), on the side of the square that will get trimmed away—this allows for "turn of the cloth".

FIGS. 6A and 6B show two strips 49 being joined with a diagonal seam 52. One sews the same as in FIG. 4 except guide the solid black line 36 slightly off the exact corner of the "square" (FIG. 6A), on the side of the strips 49. That strip will get trimmed away which allows for "turn of the cloth". FIG. 6C shows an optional method of positioning the strips 49 to be sewn in an edge "alignment".

FIG. 7 shows how to use the guide 31 to piece half-square triangles 51,51A from squares. One places two same-size squares 50,50A of fabric right sides together. Then one positions one of the side lines 37,37A on the guide 31 on top square's 50,50A opposite corners (the needle will be sewing a scant ¼ inch from the center diagonal of the squares—scant is a measurement term of art meaning, in this context, approximately 1/32 of an inch less than a full ¼ inch measurement). Next one sews across the square, being careful to keep the dashed line 37 on the guide centered over the corner of the square opposite the needle (FIG. 7A). One sews across the square a scant ¼ inch on the other side of the center diagonal 52,52A of the square, again aligning the dashed line on the guide 31 with opposite corners of the top square (FIG. 7B). One now has two diagonal lines of parallel stitching, almost ½ inch apart. One cuts on the center diagonal 52, 52A of the squares, between the lines (cut area 53) of stitching (FIG. 7C) to yield two half-square units 51, 51A (FIG. 7D).

For one to use the guide 31 to piece half-square triangles using the grid panel system which is a plurality of diagonals 50B, one only needs to draw a grid of squares (no diagonal marking necessary) on the wrong side of ones fabric panel, then one positions the dashed lines and sew as in FIG. 7A. Because one is using a gridded panel, one will sew across many squares before he or she needs to reposition the fabric (FIG. 7E).

The details mentioned here are exemplary and not limiting. Other specific components specific to describing a SEW EASY GUIDE Device 31 may be added as a person having ordinary skill in the field of sewing and quilting guides well appreciates.

OPERATION OF THE PREFERRED EMBODIMENT

Quilters and seamstresses who sew and piece fabric into intricate designs and patterns recognize the need to have an improved manner to efficiently guide the formation of squares and other geometric shapes. This is because to date the help devices have been complexly marked and awkward to use. This is a handicap that leaves many frustrated and disappointed at the time to complete a seemingly simple task of sewing the patterns to larger fabric piece.

The new SEW EASY GUIDE Device 31 addresses the needs and is simple to use. As described above in detail, the guide 31 is attached by means of the adhesive backing 38 directly to the flat plane 42 of the presser foot 40 on a sewing machine 43. Then the fabric pieces 46 and geometric shapes 45 or triangles 47,47A are sewn to the fabric 46. Likewise, strips of cloth 49 may be introduced under the guide 31 and sewn together. These various uses may be summarized for an exemplary purpose and not as a limitation in TABLE A.

TABLE A

EXAMPLES OF USES

| Item | Description of Use |
|---|---|
| 1 | Typical machine quilting without the need of marks on the fabric. FIG. 4 |
| 2 | Sewing triangle pieces across a square piece of Fabric. FIG. 5B |
| 3 | Diagonally join strips of fabric. FIG. 6D |
| 4 | Diagonally join half square triangles and then, if desires, cut the triangles apart. FIG. 7 |
| 5 | Quilt-as-one-sews seams by sewing through layers of front fabric and pieces creating a design, through the main front fabric, through the batting and through the backing fabric. Not shown. |

One should note well that the description above and the operation described here must be taken together to fully illustrate the concept of SEW EASY GUIDE Device 31. With this description it is to be understood that the SEW EASY GUIDE Device 31 is not to be limited to the disclosed embodiment. The features of the SEW EASY GUIDE Device 31 are intended to cover various modifications and equivalent arrangements included within the spirit and scope of the description.

What is claimed is:

1. A sewing guide device particularly useful with a sewing machine for accurately sewing a quilting material fabric, the guide device comprising:

(a) a sheet of thin and flexible transparent material, the sheet having an aperture at one end to provide a place for a needle of the sewing machine to reciprocate therein;

(b) one or more composite lines marked on the sheet, each composite line comprising first and second lines of first and second colors respectively, the first and second colors being different from one another;

(c) the first and second lines being mutually parallel, and being positioned with respect to one another such that two different colors appear along the length of each composite line;

(d) the sewing machine having a presser foot;

(e) the presser foot having a top surface and a bottom surface; and d) a means to attach the sheet to the bottom of the presser foot of the sewing machine.

Whereby the thin sheet permits the fabric to move under the sheet and the presser foot of the sewing machine and the sewing is guided by the lines on the device and no marks are needed on the fabric.

2. The sewing guide device according to claim 1, wherein the material being sewn is unmarked with lines.

3. The sewing guide device according to claim 1, wherein the first line is a centerline on a longitudinal direction of the sheet and second and more lines are a pre-set distance and parallel to the first line.

4. The sewing guide device according to claim 1, wherein the material being sewn is easily visible through the sheet and the lines thereon the sheet.

5. The sewing guide device according to claim 1, wherein the guide is sized and configured to removably attach contiguously by the means to the bottom surface of the presser foot of the sewing machine and the sewing machine is configured similar to one of the common types of sewing machines found in the United States sewing machine markets.

6. The sewing guide device according to claim 1, wherein the sheet is thin, transparent, of a durable material and the means to attach is on a surface of the sheet and is placed contiguous to the presser foot of the sewing machine.

7. The sewing guide device according to claim 6, wherein the means to attach has a removable protective tab to cover the means to attach when the device is being stored.

8. The sewing guide device according to claim 6, wherein the material is a composite material.

9. The sewing guide device according to claim 8, wherein the composite material is a clear plastic.

10. The sewing guide device according to claim 1, wherein the means to attach has a removable protective tab to cover the means to attach when the device is being stored.

11. The sewing guide device according to claim 1, wherein the sheet of transparent material is approximately rectangular with corners.

12. The sewing guide device according to claim 11, wherein the corners have been gradually rounded whereby a sharp corner is avoided and the material will not catch on the rounded corner of the sheet.

13. The sewing guide device according to claim 1, wherein the first color is black and the second color is red.

14. The sewing guide device according to claim 1, wherein the guide is in comparison with other sewing, measuring and design guides is inexpensive, is re-usable, and is easy to clean.

15. The sewing guide device according to claim 1, wherein the device is used for accurately sewing diagonally across squares of material without need for marking the fabric.

16. A sewing guide device particularly useful with a sewing machine for accurately sewing a quilting material fabric, the guide device comprising:

(a) a sheet of thin and flexible transparent material approximately 1 inch wide, approximately 6 inches long and approximately 15 mils thick, the essentially rectangular sheet having rounded corners and an aperture at one end to provide a place for a needle of the sewing machine to reciprocate therein;

(b) a solid centerline on the top surface of the sheet and running longitudinally and a pair of dashed second lines essentially running mutually parallel to each other and to the centerline wherein each second line is approximately a scant ¼ inch from the centerline and the centerline is positioned between the second lines;

(c) a means to attach the sheet to the sewing machine; and (d) a removable protective tab to cover the means to attach when the device is being stored.

* * * * *